US012589429B2

(12) United States Patent
Knauf et al.

(10) Patent No.: US 12,589,429 B2
(45) Date of Patent: Mar. 31, 2026

(54) METHOD FOR AUTOMATED PASS SCHEDULE CALCULATION IN RADIAL FORGING

(71) Applicant: SMS group GmbH, Düsseldorf (DE)

(72) Inventors: Frederik Knauf, Nideggen-Abenden (DE); Martin Wolfgarten, Aachen (DE)

(73) Assignee: SMS group GmbH, Düsseldorf (DE)

( * ) Notice: Subject to any disclaimer, the term of this patent is extended or adjusted under 35 U.S.C. 154(b) by 278 days.

(21) Appl. No.: 18/233,437

(22) Filed: Aug. 14, 2023

(65) Prior Publication Data

US 2024/0051014 A1 Feb. 15, 2024

(30) Foreign Application Priority Data

Aug. 15, 2022 (DE) ..... 10 2022 208 462.4

(51) Int. Cl.
*B21J 9/20* (2006.01)
*B21J 5/06* (2006.01)

(52) U.S. Cl.
CPC .. *B21J 9/20* (2013.01); *B21J 5/06* (2013.01)

(58) Field of Classification Search
CPC ..... B21J 7/04; B21J 7/16; B21J 7/06; B21J 7/14; B21J 9/20
See application file for complete search history.

(56) References Cited

FOREIGN PATENT DOCUMENTS

CN 109622849 A * 4/2019 ..... B21J 7/16

OTHER PUBLICATIONS

Translation of CN-109622849.*
Knauf et al., co-pending U.S. Appl. No. 18/233,429, filed Aug. 14, 2023.
Knauf et al., co-pending U.S. Appl. No. 18/233,445, filed Aug. 14, 2023.
SMS group, SMX Radial forging machines. All-round pioneers. Published on Jan. 11, 2021—Printed in Germany.

* cited by examiner

*Primary Examiner* — Bobby Yeonjin Kim
(74) *Attorney, Agent, or Firm* — Smartpat PLC

(57) ABSTRACT

A method for automatic calculation of a pass schedule in the radial forging of steel tubes in a radial forging machine is disclosed. The forging machine includes at least four forging tools arranged around the circumference of the workpiece, which are set up and adapted for synchronous forging operation over at least a partial length of the workpiece and/or the tube. Starting parameters for the forging process, preferably radial forging process, are entered into a pass plan calculation program and target parameters for the radial forging process are defined. The pass plan calculation program calculates a pass plan or a forging sequence on the basis of these start and target parameters.

16 Claims, 1 Drawing Sheet

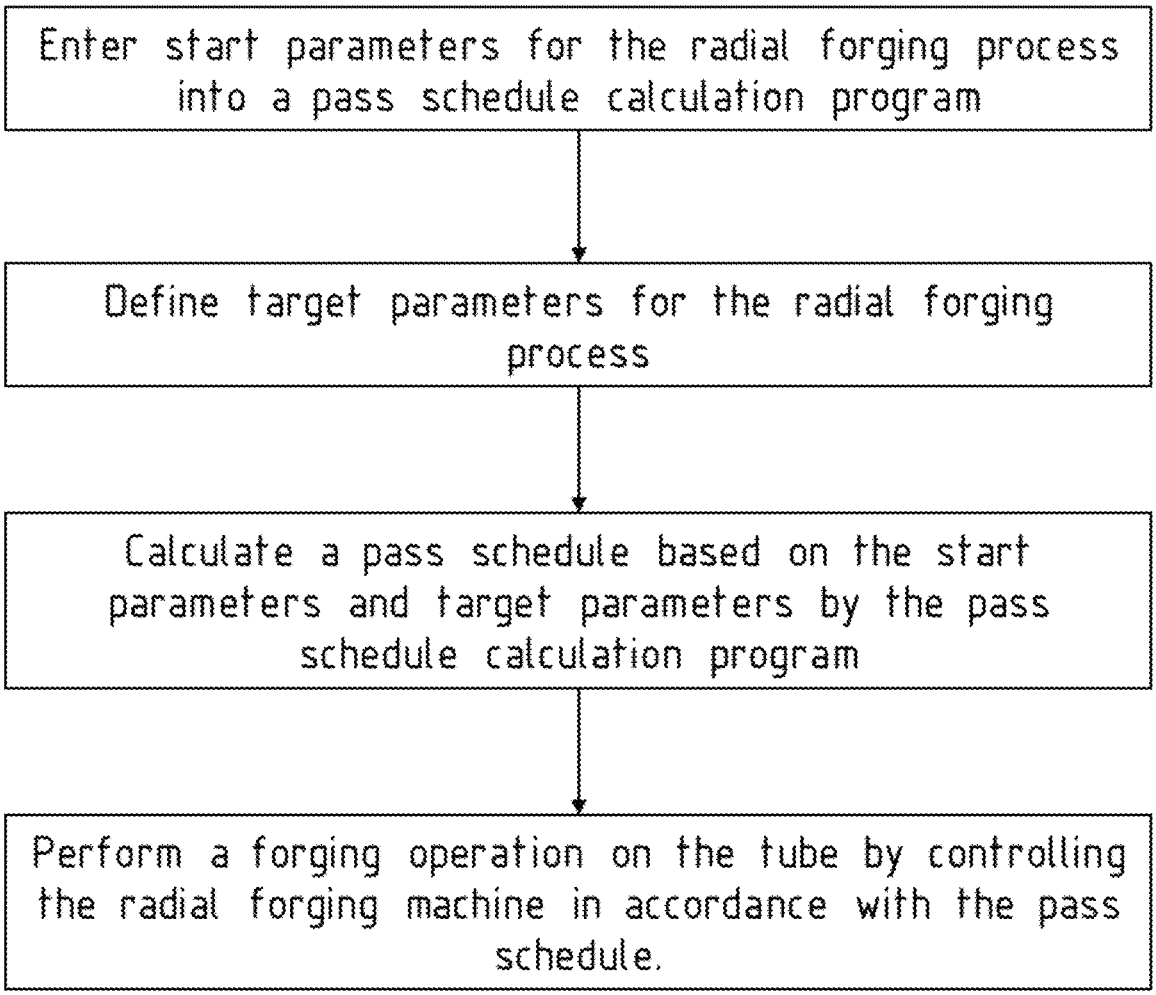
Enter start parameters for the radial forging process into a pass schedule calculation program
Define target parameters for the radial forging process
Calculate a pass schedule based on the start parameters and target parameters by the pass schedule calculation program
Perform a forging operation on the tube by controlling the radial forging machine in accordance with the pass schedule.

METHOD FOR AUTOMATED PASS SCHEDULE CALCULATION IN RADIAL FORGING

CROSS-REFERENCE TO RELATED APPLICATION

This application claims the benefit of German Patent Application DE 10 2022 208 462.4, filed on Aug. 15, 2022, the contents of which is incorporated by reference in its entirety.

TECHNICAL FIELD

The disclosure relates to a method for automated pass schedule calculation in the radial forging of tubes made of metal workpieces, in particular steel, in a radial forging machine with at least 4 forging tools arranged around the circumference of the workpiece, which are set up and adapted to simultaneously carry out the forging operation over at least a partial length of the workpiece and/or tube.

BACKGROUND

Automated pass schedule calculation for open die forging presses and radial forging machines is generally known. Currently available software that calculates the geometric parameters, such as the diameter and length of the workpiece to be formed, as well as an average temperature of the workpiece throughout the forging process, is commercially available under the brand names ForgeBase® and COMFORGE®, for example. This software enables the plant operator to enter an initial geometry and an end geometry in an input screen. based thereon, the pass schedule is calculated by the software according to defined parameters. In other words, the software calculates how many forging passes it will take to reach the final geometry and what cross-section reduction is achieved per forging pass. The degree of stretching then results from the individual deformations. In addition, the temperature and required press force are estimated after a forge pass. However, the software is only able to calculate simple geometries such as forging bar steel.

In tube forging, on the other hand, forming in a radial forging machine is usually carried out in a single-pass process, which does not have the characteristic of reversing forging. Furthermore, tubes are usually forged using a mandrel, which is inserted into the mothertube and acts to provide internal support during the forging process.

SUMMARY

In some aspects, the techniques described herein relate to a method for automatic pass schedule calculation in radial forging of tubes made of metal workpieces, in particular steel, in a radial forging machine with at least four forging tools arranged around a circumference of the workpiece. The at least four forging tools are set up and adapted to simultaneously carry out a forging operation over at least a partial length of the workpiece and/or tube. The method includes: entering start parameters for the radial forging process into a pass schedule calculation program; defining target parameters for the radial forging process; and calculating a pass schedule or a forging sequence based on the start parameters and target parameters by the pass schedule calculation program.

DESCRIPTION OF THE DRAWING

The sole FIGURE illustrates a method for automated pass schedule calculation in radial forging.

DETAILED DESCRIPTION

The present disclosure is based on a desire to further develop pass schedule calculation programs so that they can be used for complex geometries of long products such as tubes. In addition, it is an object of the invention to further optimize the forging results known from previous processes and to expand the parameters taken into account during forging.

These objects are achieved with a method as disclosed herein, a control and/or regulation unit of a radial forging machine as disclosed herein, and with a radial forging machine as disclosed herein.

The method is provided for automated pass schedule calculation in the radial forging of tubes made of metal workpieces, in particular steel, in a radial forging machine with at least 4 forging tools arranged around the circumference of the workpiece, which are set up and adapted to simultaneously carry out the forging operation at least over a partial length of the workpiece and/or tube. For that purpose, start parameters for the radial forging process are entered into a pass schedule calculation program and target parameters for the radial forging process are defined. The pass schedule calculation program calculates a pass schedule or a forging sequence based on these start and target parameters. For the first time, it is possible to use a pass schedule calculation program for tubes, which improves the degree of automation of the forging process and the reproducibility of the forging result.

In addition to the tool geometry and the possible pressing force, the pass schedule calculation program preferably takes into account the temperature variation and the temperature distribution over the cross section of the tube and the change in shape during radial forging.

By calculating the temperature distribution and the deformation distribution over the component cross section the forging result overall is optimized. The described solution is basically possible using a combination of pass schedule calculation software and the finite element method, with the pass schedule calculation software determining a pass schedule, which is then mapped using the finite element method. As a result of the finite element method, the temperature distribution and deformation distribution over the cross section of the product to be formed can be detected. However, since the calculation of the temperature distribution and deformation distribution using the finite element method is time consuming, expensive and requires technologically trained personnel to use the FEM and evaluate the results, the calculation of the temperature distribution of the deformation distribution over the component cross-section is preferably carried out using the pass schedule calculation program. With such a calculation, a statement about the quality of the forging depending on the calculated pass schedule can be made in a very simple and fast way prior to forging, which also results in the possibility of forming more complex geometries than simple steel bars. In particular, this opens up the possibility of forging tubes safely and reliably.

In the case of geometries that deviate from bar steel, the material flow during forging is of particular importance for the local deformation and thus the temperature distribution and deformation distribution over the component cross-section. The method takes these parameters into account when calculating the pass schedule and preferably offers a forging result which is optimized for the respectively desired end geometry, and which can particularly preferably be achieved automatically and reproducibly.

the pass schedule is preferably calculated taking into account several influencing parameters such as the tool geometry, the maximum possible pressing force, preferably also the feed of the workpiece, the workpiece properties such as the flow curve of the material, etc. When calculating the pass schedule, all of these parameters are preferably taken into account in such a way that all constraints, such as the maximum pressing force, are observed.

It is particularly preferred if the tube is radially forged using a tubular ingot as the workpiece, with a mandrel being introduced into the tubular ingot and serving as a support for the forging tools during radial forging. The forging process thus takes place starting from the tubular ingot with gradual deformation of the tube wall between the mandrel and the forging tools arranged around the circumference of the tubular ingot. In this context, it is particularly preferred if the wall thickness of the tube increases during the radial forging process.

Finally, in a preferred embodiment of the invention, when calculating the pass schedule, it is always taken into account that heat generated by forming, in particular cross-section reduction, leads to heating of the workpiece, which must be taken into account with different materials, especially if threshold values for microstructural deformations or the like may be exceeded. The process sequence should therefore preferably be adapted to different materials.

In a preferred embodiment of the method, the pass schedule calculation program takes into account an optimized deformation distribution, particularly preferably within a previously specified temperature range. This provides a method that takes into account the locally different deformation distribution and the associated deformation, particularly the reduction in cross section, particularly in the case of radial forging of complex workpiece geometries into long products, especially in the case of tubes. Ideally, a tube is achieved that is forged over its entire length and cross section and at the same time does not have any area that has exceeded predetermined and material-dependent threshold values for temperature due to increased reshaping. A tube is thus obtained that has a microstructure that is optimized over its length and cross section and, associated therewith, has optimized workpiece properties.

In this context, it is particularly preferred if the pass schedule calculation program takes into account the optimized deformation distribution and the temperature variation and temperature distribution. In this way, a method is made available which ensures that at no time during the radial forging process predetermined threshold values with regard to the system and method parameters are exceeded.

In a further embodiment of the invention, it is preferred if the starting parameters, which are entered into a pass schedule calculation program, include the starting geometry of the workpiece, its dimensions, its starting temperature, in particular the furnace temperature at which the workpiece was removed before the start of the radial forging process, and the material of the workpiece.

It is also preferable if the target parameters that are specified for the radial forging process and entered into the pass schedule calculation program are the target geometry of the tube, its final wall thickness and dimensions, and a shape change that is as homogeneous as possible. The deformation distribution over the cross section of the tube and/or the temperature distribution over the cross section of the tube are then the result of such a forging process. In this way, a method is made available which, with regard to the radial forging process, knows all the parameters required for optimal use of the pass schedule calculation program and takes them into account when calculating the pass schedule.

In this context, it is particularly preferred if an optimized deformation distribution, in particular over the individual steps of the forging process, is calculated by the pass schedule calculation program based on the target parameters of the temperature variation and temperature distribution, or that the temperature variation and temperature distribution, in particular over the individual steps of the forging process, are calculated based on an optimized deformation distribution being the target parameter. The method thus uses either the temperature variation and temperature distribution to optimize the deformation distribution, or uses the deformation distribution to optimize the temperature variation and temperature distribution, in particular over the individual steps of the forging process, and thus optimizes the pass schedule calculation program and finally the forging result itself.

It is also particularly preferred if an optimized microstructure or an optimized microstructure distribution is calculated by the pass schedule calculation program based on the target parameters of temperature variation and temperature distribution. As an alternative to this, in an equally preferred embodiment, the temperature variation and temperature distribution can be calculated using the microstructure as target parameters. In any case, a long product is obtained by radial forging, which preferably has a predetermined microstructure or a predetermined microstructure distribution in each component cross section.

In this context, it is also preferred if the pass schedule calculation program takes into account the heat of forming introduced into the workpiece by the forming, in particular cross-section reduction, during radial forging. the reduction in cross section, introduces significant energy into the workpiece and this energy is reflected not only in the resulting change in shape, but also in a clearly measurable increase in the temperature of the workpiece. This increase in the workpiece temperature is often significantly different locally in the case of different formings that affects the workpiece and thus also has a locally significant influence on the existing or developing microstructure. Taking into account the forming heat introduced into the workpiece thus supports the method in achieving an optimal radial forging result.

In addition, it is particularly preferred if the method employs an online connection to a press control unit and can output optimized control commands during the radial forging process on the basis of measured values and/or calculated values. A control of the method designed in this way uses either suitable measurement results, in particular measured surface temperatures, or where measurements cannot be taken or would be difficult to take, calculated values for regular and ideally permanent online control of the radial forging process. This supports the goal of an optimized method for automated pass schedule calculation in the radial forging of tubes made of metal workpieces in a particularly advantageous manner and with easily manageable means.

According to a further aspect, a control and/or regulation unit of a radial forging machine is provided, the control or regulation unit containing a pass schedule calculation program for executing the method according to the first aspect or at least cooperating with it.

According to a third aspect, a radial forging machine for the radial forging of tubes made of metal workpieces, in particular made of steel, is provided with at least 4 forging tools arranged around the circumference of the workpiece, which are set up and adapted to synchronously carry out the forging operation at least over a partial length of the workpiece and/or tube, wherein the radial forging machine according to the third aspect is connected to a control and/or regulation unit according to the second aspect or at least cooperates with it. In this way, a radial forging machine is made available which is able to provide the plant operator with all the technical effects associated with the method in accordance with the first aspect in a reliable and reproducible manner.

As already described above, such a radial forging machine is particularly preferably adapted and designed to carry out the radial forging of tubes. In a preferred embodiment of the invention, this takes place with the assistance of a mandrel which is introduced into the workpiece or tube and is arranged there during the radial forging.

What is claimed is:

1. A method for radial forging a tube made of metal in a radial forging machine with at least four forging tools arranged around a circumference of the tube, the method comprising:

entering start parameters for the radial forging process into a pass schedule calculation program;

defining target parameters for the radial forging process;

calculating a pass schedule based on the start parameters and target parameters by the pass schedule calculation program; and performing a forging operation on the tube by controlling the radial forging machine in accordance with the pass schedule.

2. The method according to claim 1, wherein the pass schedule calculation program takes into account a tool geometry, a maximum press force, a temperature variation and a temperature distribution over a cross section of the tube, and a change in shape during radial forging.

3. The method according to claim 1, wherein the tube is radially forged with a mandrel introduced into a tubular ingot.

4. The method according to claim 3, wherein a wall thickness of the tube decreases during the radial forging, or in case of radial forging on the mandrel the wall thickness of the tube increases.

5. The method according to claim 2, wherein the pass schedule calculation program takes into account a deformation distribution within a predetermined temperature range in the tube.

6. The method according to claim 5, wherein the pass schedule calculation program takes into account the deformation distribution and the temperature variation and the temperature distribution.

7. The method according to claim 1, wherein the starting parameters include at least a starting geometry of the tube, its dimensions, starting temperature, and material.

8. The method according to claim 1, wherein the target parameters include at least a target geometry of the tube, its final wall thickness and dimensions, and deformation distribution over a cross section of the tube, and/or a temperature distribution over the cross section of the tube.

9. The method according to claim 8, wherein based on the target parameters of temperature variation and temperature distribution, a deformation distribution over individual steps of the forging operation is calculated by the pass schedule calculation program, or wherein based on the target parameter of a deformation distribution, the temperature variation and temperature distribution over the individual steps of the forging operation is calculated.

10. The method according to claim 1, wherein a microstructure or a microstructure distribution is calculated by the pass schedule calculation program based on the target parameters of temperature variation and temperature distribution.

11. The method according to claim 2, wherein the temperature variation and temperature distribution are calculated using a microstructure as target parameter.

12. The method according to claim 1, wherein the pass schedule calculation program takes into account heat of deformation introduced into the tube by deformation work during radial forging.

13. The method according to claim 1, wherein the pass schedule calculation program takes into account a feed rate and a material of the tube.

14. A control and/or regulation unit of a radial forging machine, with a pass schedule calculation program for carrying out the method according to claim 1.

15. A radial forging machine for the radial forging of a tube made of metal, comprising:

at least four forging tools arranged around a circumference of the tube, which are set up and adapted to simultaneously carry out a forging operation over at least a partial length of the tube; and a control and/or regulation unit including a pass schedule calculation program, the control and/or regulation unit being configured for entering start parameters for the radial forging operation into the pass schedule calculation program, defining target parameters for the radial forging operation, calculating a pass schedule or a forging sequence based on the start parameters and target parameters by the pass schedule calculation program, and controlling the at least four forging tools and executing the pass schedule or the forging sequence.

16. The radial forging machine according to claim 15, further comprising a mandrel capable of being introduced into the tube, wherein the radial forging can be carried out with the mandrel arranged in the tube.

* * * * *